United States Patent [19]

Scott

[11] Patent Number: 4,567,730

[45] Date of Patent: Feb. 4, 1986

[54] SHIELDED COMBUSTOR

[75] Inventor: Thomas L. Scott, Marblehead, Mass.

[73] Assignee: General Electric Company, Lynn, Mass.

[21] Appl. No.: 538,302

[22] Filed: Oct. 3, 1983

[51] Int. Cl.[4] ..... F02G 3/00

[52] U.S. Cl. ..... 60/757; 60/39.32; 60/752; 60/753; 60/755

[58] Field of Search ..... 60/39.32, 752, 753, 60/755, 757

[56] References Cited

U.S. PATENT DOCUMENTS

| | | | |
|---|---|---|---|
| 2,268,464 | 12/1941 | Seippel | 263/19 |
| 2,500,925 | 3/1950 | Bonvillian et al. | 60/44 |
| 2,547,619 | 4/1951 | Buckland | 60/44 |
| 2,645,081 | 7/1953 | McDonald | 60/39.65 |
| 2,699,648 | 1/1955 | Berkey | 60/39.65 |
| 3,422,620 | 1/1969 | Fantozzi et al. | 60/39.32 |
| 3,854,503 | 12/1974 | Nelson et al. | 60/753 |
| 4,016,718 | 4/1977 | Lauck | 60/39.32 |
| 4,302,941 | 12/1981 | DuBell | 60/757 |
| 4,380,896 | 4/1983 | Wiebe | 60/39.32 |

FOREIGN PATENT DOCUMENTS

| | | | |
|---|---|---|---|
| 763692 | 12/1956 | United Kingdom | 60/39.32 |
| 197803 | 3/1978 | United Kingdom | 60/39.32 |

*Primary Examiner*—Stephen J. Lechert, Jr.

*Attorney, Agent, or Firm*—Francis L. Conte; Derek P. Lawrence

[57] ABSTRACT

A radial lip of a high temperature combustor liner is mechanically locked in a radially directed capture slot in a supporting shell of a combustor. In one embodiment, the capture slot is formed at abutting edges of shell sections which are joined by a weld bead. The weld bead is accessible for grinding off to provide access to the liner for replacement. In embodiments in which a plurality of liner sections are employed, a downstream end of a liner section overlaps and shields an upstream end of an adjacent liner section including the radial lip thereof to protect the radial lip and capture slot from temperatures in the combustion zone and to channel a sheet flow of film cooling air along an inner surface of the adjacent liner. Positioning bosses may be included between adjacent liner sections for centering.

28 Claims, 3 Drawing Figures

SHIELDED COMBUSTOR

The Government has rights in this invention pursuant to Contract No. N00019-76-C-0261 awarded by the Navy.

BACKGROUND OF THE INVENTION

The present invention relates to gas turbine combustors and, more particularly, to a combustor having a liner arrangement capable of withstanding elevated temperatures.

The increasing efficiency of thermal engines with increasing temperature has justified attempts to increase the combustion temperatures in such engines. The principal limitation on the combustion temperature has been the availability of suitable materials to contain the combustion process.

For use in a gas turbine engine, materials have been developed with suitable manufacturable properties capable of withstanding about 1550 degrees F maximum for extended periods of time. At higher temperatures, these materials suffer thermal distress which results in corrosion and/or distorton.

In the prior art, in order to extend the operating temperature of a combustor beyond the capability of the available high-temperature materials, it is known to fabricate gas turbine combustors with relatively complex, and, therefore, undesirable, liner structures supported by a shell.

Furthermore, in advanced systems, the temperature of air available for cooling the combustor is generally increasing. More specifically, and for example, compressor pressure ratios are increasing resulting in higher temperature of the compressor discharge air, for example, about 800 to 1100 degrees F. In advanced systems including a regenerator or recuperator, the compressor outlet air temperature being fed to the combustor through the regenerator may be increased from conventional temperatures to about 1400 to about 1600 degrees F. Thus in these advanced systems, there is an insufficient temperature difference between the compressed air available for cooling and the temperature limit of the materials requiring cooling to maintain the temperature of the combustor liner within a range which can be withstood by conventional combustor materials.

A further trend requiring higher temperature materials in a gas turbine combustor is a move toward higher energy fuels currently not in conventional use in such engines. Some applications, for example, may require the use of a fuel which has a high energy per unit volume. Such fuels may typically consist of a slurry having a liquid hydrocarbon carrier containing carbon and/or powdered metal such as aluminum, boron or zinc. Such fuels contribute increased temperature to the combustor liner in two ways. Typically, high energy slurry fuels have higher flame temperatures than hydrocarbon fuels alone. In addition, such slurry fuels have a much higher radiant emissivity than do conventional hydrocarbon fuels and therefore produce a high radiant flux which transfers thermal energy to the combustor liner. This combination produces a requirement for a combustor liner which can withstand about 2000 to 3000 degrees F.

Although liner materials exist which can withstand higher temperatures, they lack required properties of formability, machinability, weldability and ductility which would permit their fabrication into conventional combustion chamber liners without having relatively complex shapes and attachment arrangements to the remainder of the structure. Several desirable high-temperature liner materials such as certain ceramics and certain fibers in binders can withstand temperatures considerably in excess of 1550 degrees F.

For example, silicon carbide can withstand temperaures as high as about 2800 degrees F.

Another high-temperature material includes a carbon fiber supported in a carbon binder, i.e., carbon-carbon, which can withstand up to about 3000 degrees F. This material must be protected from oxygen by a high-temperature glass or ceramic surface layer to prevent oxidation thereof.

A further high-temperature material includes an oxide dispersion stabilized nickel, chrome alloy, conventionally identified as MA-956 which can withstand temperatures up to about 2100 degrees F.

Conventional combustors typically utilize materials having substantially equal thermal coefficients of expansion for both the liner and the shell structure. This is preferred for reducing thermal stress and strain due to differential thermal expansion and contraction between the liner and its supporting shell.

However, the above-described high temperature liner materials typically have thermal coefficients of expansion which are substantially different than those of conventional shell structures. In a conventional shell-liner arrangement, this would result in increased thermal stress due to differential expansion and contraction. In an arrangement including a ceramic liner, for example, these thermal stresses would cause the brittle ceramic liner to fracture in operation, which is, therefore, not acceptable.

OBJECTS AND SUMMARY OF THE INVENTION

Accordingly, it is an object of the present invention to provide a new and improved combustor.

It is a further object of the invention to provide a combustor which takes advantage of materials capable of withstanding higher temperatures.

It is a further object of the invention to provide a combustor capable of supporting a combustor liner having a substantially different thermal coefficient of expansion from the remainder of the structure.

It is a further object of the invention to provide a combustor including a relatively simple combustor assembly including a liner which is captured in position while allowing differential thermal movement between the liner and the surrounding structure.

Briefly stated, the present invention provides a new and improved combustor for a gas turbine engine including a shell having a capture slot extending in a substantially circumferential direction, and a liner having a lip disposed in the slot for supporting the liner at one end thereof. This arrangement is effective so that the liner may be made of a high temperature material which is ordinarily difficult to fabricate and support. In one embodiment, the capture slot is formed at the junction of two shell sections and, for access to a liner section for replacement, a weld bead joining the two shell sections may be ground off to thereby open the capture slot. Liner sections of high temperature material overlap at their junctions to protect the lip and to provide a sheet flow of cooling air along downstream inner surfaces.

The above, and other objects, features and advantages of the present invention will become apparent from the following description read in conjunction with the accompanying drawings, in which like reference numerals designate the same elements.

DETAILED DESCRIPTION OF THE PREFERRED EMBODIMENT

Figure 1:
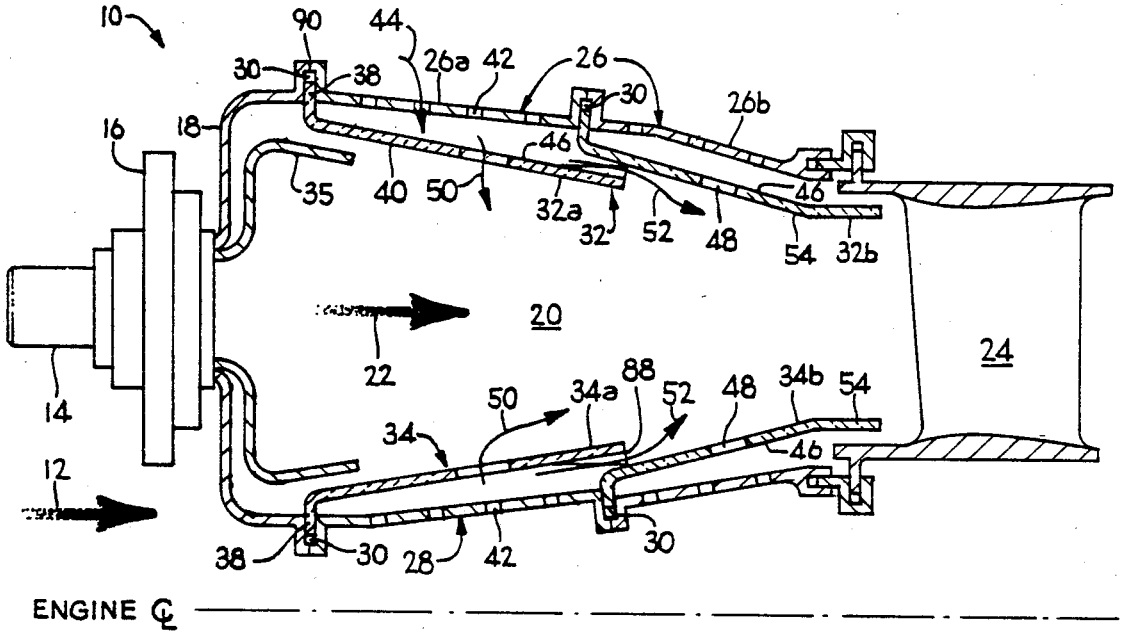
FIG. 1 is a cross section of a combustor according to one embodiment of the invention.

Referring now to FIG. 1, a combustor of a gas turbine engine, according to one embodiment of the present invention, is shown generally at 10. As is conventional, pressurized air 12 from a compressor (not shown) is channeled to the exterior of combustor 10. Combustor 10 may be an annular structure as illustrated or may be, for example, a can-type combustor.

A conventional fuel injector 14 injects atomized fuel, optionally mixed with air in a swirler 16, into a dome 18 of combustor 10. An igniter or cross-fire tube (not shown) ignites the air-fuel mixture downstream of fuel injector 14. Fuel burning continues in a combustion zone 20 of combustor 10 aided by suitably supplied additional injection air. Combustion gases 22 exit from combustor 10 through a turbine nozzle 24 which directs the high energy, fast moving combustion gas stream 22 upon a row of turbine blades or buckets (not shown) which thereupon rotate a turbine wheel (not shown) which delivers rotational energy to the compressor, and optionally to a load. In some applications, instead of the turbine wheel driving a load, the output power is derived from a high speed jet of hot gas which produces thrust.

Except for the combustor 10, the remainder of the gas turbine engine is conventional and will not be described in further detail. Examples of gas turbine engines, including prior art combustors, are disclosed in U.S. Pat. Nos. 2,547,619 to Buckland and 2,699,648 to Berkey, both assigned to the present assignee, and incorporated herein by reference.

According to one embodiment of the invention, the combustor 10 includes annular, radially outer and inner supporting members or shells 26 and 28, respectively, each including one or more capture slots 30 disposed therein. As illustrated in FIG. 1, a plurality of annular, axially spaced capture slots 30 are disposed in the shells 26 and 28. The slots 30 of the outer and inner shells 26 and 28, respectively, extend in a substantially circumferential direction and have their openings facing in generally radially inward and outward directions, respectively. Also illustrated is a capture slot 30 suitably formed at the junction of the dome 18 and the shell 26.

The combustor 10 also includes circumferentially arcuate outer and inner liners 32 and 34, respectively. In the embodiment of the invention illustrated in FIG. 1, the liners 32 and 34 comprise a plurality of overlapping liner sections 32*a* and 32*b*, and 34*a* and 34*b*, respectively, disposed in respective ones of the slots 30. An extended baffle or splashplate 35 is also provided and extends from the swirler 16 to partially cover the liners 32 and 34 for shielding the dome 18 from the combustion gases 22.

Figure 2:
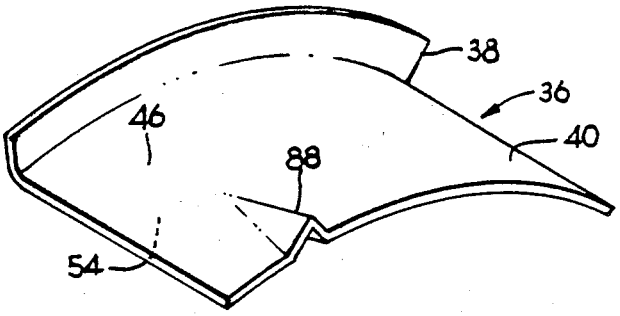
FIG. 2 is a perspective view of a liner segment according to another embodiment of the invention.

As illustrated in FIG. 1, the liners 32 and 34 comprise annular rings. However, the liners 32 and 34 may comprise a plurality of arcuate liner segments 36, one of which is illustrated in FIG. 2, disposed in circumferential alignment in a ring-like fashion.

Inasmuch as the outer and inner shells 26 and 28 and liners 32 and 34 are similar in construction and are generally mirror images of each other, the invention as described with respect to only outer shell 26 and outer liner 32 will be further described in detail. However, it is understood that the scope of the present invention also includes the inner shell 28 and the inner liner 34 of the combustor 10.

The outer liner 32 includes a lip or lip portion 38 and a shield portion 40, each preferrably disposed at upstream and downstream ends, respectively, of the liner 32. The lip 38 is inclined relative to the shield portion 40 and, in the embodiment illustrated, is disposed substantially perpendicularly to and in a generally radially outward direction from the shield portion 40. Similarly, the lip 38 of the inner liner 34 is inclined in a generally radially inward direction.

The lip 38 of the liner 32 is simply or loosely disposed or captured in the capture slot 30 without being fixedly attached thereto. This arrangement, including the lip 38, is effective for simply supporting the liner 32 at only one end thereof, i.e., the lip 38 end, in the outer shell 26. The shield portion 40 extends downstream in the combustor and is disposed between the shell 26 and the combustion zone 20 for shielding the outer shell 26 from the combustion gases 22.

It will be appreciated that inasmuch as the liner 32 comprises an annular ring, or an annular ring-like member comprised of a plurality of liner segments 36 as illustrated in FIG. 2 and disposed in circumferential alignment in the slot 30, the liner 32 may be axially and radially supported at only one end thereof by disposing the lip 38 in the slot 30. The liner 32 is thereby free to thermally expand and contract from the lip 38. This is a significant life improvement feature of the present invention inasmuch as stresses due to differential thermal expansion and contraction between the shell 26 and the liner 32 are substantially reduced, if not eliminated, because the liner 32 is free to expand in the generally axial and radial directions.

Furthermore, inasmuch as the liner 32 is supported at only one end, the liner 32 may be a relatively simple structure, including at least the lip 38 and the shield portion 40. Conventional complex shapes and multipoint support arrangements are not required, and, therefore, weldability and ductility, for example, are no longer limitations in the choice of materials utilized.

Accordingly, the material of the liner 32 is no longer limited to conventional materials, such as HAST-X or HS-188, for example, but may now comprise a material effective for withstanding higher temperatures than the shell material. Inasmuch as the shield portion 40 of the liner 32 is disposed between the combustion zone 20 and the shell 26, the liner 32 is exposed to temperatures substantially higher than those of the shell 26. Therefore, the shell 26 and the liner 32 may comprise dissimilar materials: the shell 26 can be simply made of conventional materials, and materials having improved high-temperature properties may be used for the liner 32.

For example, the liner 32 may comprise ceramic or carbon-carbon materials. These materials have greater oxidation resistance than the above-described conventional material, and are effective for retaining their shapes at elevated temperatures, thusly withstanding higher temperatures than the conventional materials of the shell 26. Although these high temperature materials may be difficult to manufacture, it will be appreciated that the liner 32 is a relatively simple structure inasmuch as it is mounted to the shell 26 at only one end, and, therefore, is more easily fabricated.

Furthermore, it is generally known that ceramics, for example, are typically brittle structures that are unable to withstand substantial stresses therein. Inasmuch as the liner 32 is allowed to freely expand and contract with respect to the shell 26, stresses therein are significantly reduced, thus allowing a ceramic material to be used.

It should be noted that in conventional combustor assemblies wherein a liner is attached to a supporting shell structure at more than one point, materials are chosen which have substantially identical coefficients of thermal expansion for reducing stresses due to differential thermal expansion and contraction. However, in accordance with the present invention, materials used for the liner 32 may now include substantially different thermal coefficients of expansion from that of the shell 26 as above described.

Additional features of the present invention include a plurality of cooling air apertures 42 disposed in outer shell 26 which are effective for channeling high speed jets of impingement cooling air 44 upon outer surface 46 of liner 32. The air between outer shell 26 and liner 32 may flow radially through an optional dilution air aperture 48 in liner 32 that is effective for receiving and directing a portion of the impingement air 44 to provide dilution air 50 into the combustion zone 20 for completing combustion and for reducing the temperature of the combustion gases 22. In addition, a portion of the impingement cooling air 44 also flows between outer shell 26 and liner 32 axially in the downstream direction to produce a sheet flow of film cooling air 52. The film cooling air 52 flows between adjacent overlapping liner sections 32*a* and 32*b* and over an inner surface 54 of the downstream liner section 32*b*. The film cooling air 52 tends to keep the inner surfaces 54 of liner 32 at a reduced temperature compared to the temperature they would attain without this provision.

Figure 3:
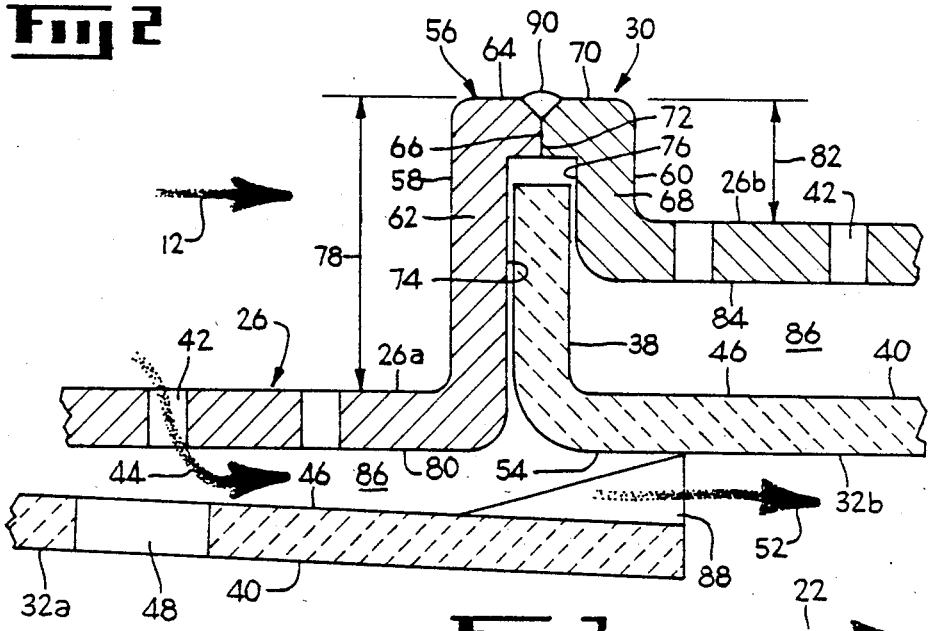
FIG. 3 is an enlarged view of a capture slot suitable for the embodiment of FIG. 1.

Illustrated in more detail in FIG. 3 is an exemplary, preferred construction of the capture slot 30 for the combustor 10 illustrated in FIG. 1. In the embodiment shown, the slot 30 is generally U-shaped and includes an apex 56. The outer shell 26 includes axially adjacent first and second shell sections 26*a* and 26*b*, respectively, which are fixedly attached to each other at complementary ends 58 and 60, respectively, thereof defining the slot 30 and the apex 56.

Capture slot 30 is also defined by a first radially directed wall 62 integral with the downstream end 58 of first shell section 26*a*. A right-angled first bend 64 at the radially outer end of the first wall 62 positions a first mating surface 66 in a generally radial orientation. Similarly, a second radially directed wall 68 integral with the upstream end 60 of shell section 26*b* includes a right-angled second bend 70 at the radially outer end thereof to position a second mating surface 72 parallel to the first mating surface 66. The first and second bends 64 and 70 are effective to place the first and second mating surfaces 66 and 72 in mutual abutment. Inner wall surfaces 74 and 76 of walls 62 and 68, respectively, are parallel to each other and are disposed radial to the centerline of combustor 10 to define the capture slot 30.

The radial lip 38 of a second liner section 32*b* fits into capture slot 30. The shield portion 40 of a first liner section 32*a* is radially spaced from and overlaps the lip 38 and the upstream end of shield portion 40 of the second liner section 32*b* a suitable distance to effectively shield the lip 38 and the slot 30 from direct exposure to the combustion gases 22 within combustor 10. Thus lip 38 and walls 62 and 68 are effectively isolated from the combustion gases 22 and receive substantial cooling from the air flows 12 and 52.

It will be noted from the exemplary embodiment of the capture slot 30 illustrated in FIG. 3 that radial dimensions of walls 62 and 68 may be made different. That is, first wall 62 has a first, greater radial dimension 78 so that a first inner surface 80 of first shell section 26*a* is generally aligned with the inner surface 54 of liner section 32*b*. A second radial dimension 82 of wall 68 is substantially smaller than the first radial dimension 78 so that an inner surface 84 of shell section 26*b*, together with the outer surface 46 of liner section 32*b* defines an air flow channel 86 for the flow of impingement air 44 and film air 52 therebetween.

Although shell sections 26*a* and 26*b* may have a thermal coefficient of expansion which is substantially different from the thermal coefficient of expansion of liner 32 and its lip 38, the fact that radial lip 38 is merely captured in capture slot 30, thereby permitting substantial motion of lip 38, eliminates mechanical stresses which would otherwise be produced by the difference in expansion of these materials. Therefore, liner 32 may be made of ceramic or other materials which lack the manufacturability heretofore required since machining and joining of this material is not required to practice the present invention.

It will be noted that lip 38 can move a substantial radial distance in capture slot 30 for accommodating a radial component of any differential thermal expansion between the shell 26 and liner 32. In certain cases, it may be desirable to employ means for centering liner 32 with respect to the shell 26. This may be accomplished by providing a plurality of circumferentially spaced stand-offs or bosses 88, three equally spaced bosses 88 are preferred, on the outer surface 46 of liner section 32*a*, as shown in more detail in FIGS. 2 and 3, to contact the inner surface 54 of liner section 32*b* or vice versa. Since these two liner sections, 32*a* and 32*b*, being made of the same material, have substantially the same thermal coefficient of expansion, stabilizing contact with bosses 88 should not lead to cracking or other damage. As the location of bosses 88 is protected from direct contact with the combustion gases 22, a resilient material of lower temperature properties than liner 32 may be employed in the general location occupied by bosses 88 or in other convenient locations such as, for example, between shell section 26*b* and liner section 32*b*. Due to the resilience of such resilient centering bosses (not shown) the difference in expansion of shell section 26*b* and liner section 32*b* may be accommodated.

In some applications, provision for replacement of liner sections may be desirable. This can be readily accomplished in the embodiment of FIGS. 1 and 3 by including a weld bead 90 joining a radially outermost portion of the first and second mating surfaces 66 and 72 in the apex 56. Although a weld bead 90 is disclosed, any suitable form of joining, such as bolting, riveting or clamping, may also be utilized.

A method of repairing the combustor 10 would then include separating the shell 26 at the capture slot 30 by suitably removing the weld bead 90, by grinding for example, to separate shell sections 26*a* and 26*b* and to thereby release lip 38 from capture slot 30. The released liner 32 can thereupon be replaced by inserting a lip 38 of a new replacement liner 32 in place between the separated shell sections 26*a* and 26*b* and joining, by welding for example, the separated sections to produce a new weld bead 90.

It would be clear to one skilled in the art that combustors may be produced by employing one or more liner sections 32 captured in a plurality of axially spaced capture slots 30 and overlapping in the manner shown in FIG. 1. In a simple one-use engine, a single liner section 26*a* of high temperature material may be employed to comprise the entire liner.

Having described specific preferred embodiments of the invention with reference to the accompanying drawings, it is to be understood that the invention is not limited to these embodiments, and that various changes and modifications may be effected therein by one skilled in the art without departing from the scope or spirit of the invention as defined in the appended claims.

For example, although a particular type of and method for forming the slot 30 are disclosed, it will be appreciated from the teachings herein, that any suitably formed slot 30 may be utilized. The slot 30 may be directed substantially radially or may even be inclined for some applications. Furthermore, where liner segments 36, such as illustrated in FIG. 2, are utilized, a method of repairing may include removing the liner segment 36 from within the combustor 10. Replacement liner segments may then be inserted one at a time with suitable means being employed for installing the last segment and creating a ring-like structure.

Having thus described the invention, what is claimed as novel and desired to be secured by Letters Patent of the United States is:

1. A combustor having a combustion zone comprising:

a shell including a capture slot, said slot extending in a substantially circumferential direction and having an opening facing in a radial direction;

an arcuate liner having a lip, said lip being disposed in said slot for supporting said liner at one end in said shell, and a shield portion disposed between said shell and the combustion zone; and said lip being loosely disposed in said slot to permit movement of said lip in said slot for accommodating a radial component of differential thermal expansion between said shell and said liner.

2. A combustor according to claim 1 wherein said liner comprises an annular ring.

3. A combustor according to claim 1 wherein said liner comprises a plurality of liner segments disposed in circumferential alignment in said slot.

4. A combustor according to claim 1 wherein said shell and said liner comprise dissimilar materials, said liner material being suitable for withstanding higher temperatures than said shell material.

5. A combustor according to claim 4 wherein said liner material comprises ceramic.

6. A combustor according to claim 4 wherein said liner material comprises carbon-carbon.

7. A combustor according to claim 1 wherein said lip is disposed on an upstream end of said liner.

8. A combustor according to claim 1 wherein said shell comprises an outer shell and said opening faces radially inwardly; and said liner comprises an outer liner and said lip is inclined in a generally radially outward direction.

9. A combustor according to claim 1 wherein said shell comprises an inner shell and said opening faces radially outwardly; and said liner comprises an inner liner and said lip is inclined in a generally radially inward direction.

10. A combustor according to claim 1 further including a plurality of axially spaced capture slots disposed in said shell, and wherein said liner comprises a plurality of liner sections disposed in respective ones of said slots, each of said liner sections having a lip and shield portion.

11. A combustor according to claim 10 wherein a shield portion of a first liner section is spaced radially from and overlaps a lip of an adjacent second liner section for shielding said lip and said slot from combustion gases.

12. A combustor according to claim 11 wherein one of said first and second liner sections includes three bosses disposed to bear on the other thereof and effective for centering at least one of said first and second liner sections in said combustor.

13. A combustor according to claim 10 further including a plurality of cooling air apertures disposed in said shell and being effective for directing cooling air to impinge against an outer surface of said liner and to flow over an inner surface of an adjacent downstream one of said liners.

14. A combustor according to claim 13 wherein one of said liners includes a dilution aperture effective for receiving and directing a portion of said impingement air to dilute combustion gases in said combustor.

15. A combustor according to claim 1 wherein said slot is generally U-shaped and includes an apex.

16. A combustor according to claim 15 wherein said slot is defined by complementary ends of adjacent first and second shell sections fixedly attached to each other at said apex.

17. A combustor according to claim 16 wherein said slot includes a first radially directed wall integral with a downstream end of said first shell section, a second radially directed wall integral with an upstream end of said second shell section, a first bend at a radially outer end of said first radially directed wall, a second bend at a radially outer end of said second radially directed wall, said first and second bends being effective to place first and second mating surfaces in mutual abutment.

18. A combustor according to claim 17 further including a weld bead joining a portion of said first and second mating surfaces.

19. A combustor according to claim 18 wherein said portion is a radially outermost portion whereby said weld bead is removable to permit access to a liner supported in said slot.

20. A combustor according to claim 17 wherein said first radially directed wall has a first radial dimension effective to substantially align an inner surface of said first shell section with an inner surface of a liner supported in said slot, said second radially directed wall has a second radial dimension smaller than said first radial dimension for defining an air flow channel.

21. A combustor for a gas turbine engine comprising:

a dome;

an outer shell having at least first and second shell sections;

a first radially directed capture slot at a junction of said dome and said first second shell section;

a second radially directed capture slot at a junction of said first and second shell sections;

a first liner section inside said shell; including a first radially directed lip on an upstream end thereof captured in said first radially directed capture slot and effective to retain said first liner section in said combustor spaced inward of said first shell section to form a first flow channel;

at least a second liner section inside said shell; including a second radially directed lip on an upstream end thereof captured in said second radially directed capture slot and effective to retain said second liner section in said combustor spaced inward of said second shell section; and means for admitting a flow of air through said first shell section into said flow channel;

said first and second lips being loosely disposed in said first and second slots, respectively, to permit movement of said lips in said slots for accommodating a radial component of differential thermal expansion between said shell and said first and second liner sections; and a downstream end of said first liner section being spaced radially inward from and overlapping an upstream end of said second liner section to permit sheet-type film cooling airflow from said flow channel along an inner surface of said second liner section, said overlapping and said airflow being effective to shield said second radially directed capture slot from temperature in a combustion zone of said combustor.

22. For a combustor including a shell having a capture slot for receiving and loosely supporting from one end a liner to permit movement of said liner in said slot for accommodating a radial component of differential thermal expansion between said shell and said liner, an arcuate liner comprising a lip and a shield portion, said lip being inclined substantially perpendicularly to said shield portion.

23. A liner according to claim 22 comprising a material dissimilar to that of the shell, said liner material being suitable for withstanding higher temperatures than the shell material.

24. A liner according to claim 23 wherein said liner material comprises ceramic.

25. A liner according to claim 23 wherein said liner material comprises carbon-carbon.

26. A method for repairing a combustor including a shell having a capture slot that receives and supports from one end a liner having a lip portion loosely disposed in said slot to permit movement of said liner in said slot for accommodating a radial component of differential thermal expansion between said shell and said liner, comprising the steps of:

separating said shell at said capture slot;

removing said liner from between separated sections of said shell;

inserting a replacement liner between said separated sections of said shell; and joining said separated sections of said shell to loosely engage a lip portion of said replacement liner.

27. A combustor according to claim 1 wherein said capture slot and said lip both extend in a substantially radial only direction.

28. A combustor according to claim 21 wherein said first and second capture slots and said first and second lips extend in a substantially radial only direction.

* * * * *